United States Patent [19]

Hermanson

[11] Patent Number: 4,601,301

[45] Date of Patent: Jul. 22, 1986

[54] UMBRELLA WITH LAZY TONG STRUCTURE

[76] Inventor: Terry Hermanson, c/o 41 Madison Ave., New York, N.Y. 10010

[21] Appl. No.: 746,529

[22] Filed: Jun. 19, 1985

[51] Int. Cl.[4] ..... A45B 19/00; E04H 15/50

[52] U.S. Cl. ..... 135/25 R; 135/100; 135/DIG. 2

[58] Field of Search ..... 135/16, 20 R, 20 A, 135/20 M, 25 R, 25 A, 26, DIG. 2, DIG. 3, 110, 111

[56] References Cited

U.S. PATENT DOCUMENTS

| | | | |
|---|---|---|---|
| 23,503 | 4/1859 | Seldon | 135/25 A |
| 256,308 | 4/1882 | Forster | 135/20 A |
| 858,527 | 7/1907 | Minor | 135/25 A |
| 1,328,901 | 1/1920 | Ryder | 135/20 A |
| 1,672,909 | 6/1928 | Ryder | 135/20 A |
| 1,890,440 | 12/1932 | Monz et al. | 135/25 R |
| 2,334,330 | 11/1943 | Janowsky | 135/26 |
| 2,412,415 | 12/1946 | Navon | 135/16 X |
| 2,528,578 | 11/1950 | Clapper | 135/20 A X |
| 2,707,476 | 5/1955 | Clemmens | 135/20 A |

FOREIGN PATENT DOCUMENTS

| | | | |
|---|---|---|---|
| 565539 | 1/1924 | France | 135/25 |
| 8760 | of 1889 | United Kingdom | 135/20 A |
| 3143 | of 1915 | United Kingdom | 135/20 A |

*Primary Examiner*—Robert E. Bagwill
*Assistant Examiner*—D. Neal Muir
*Attorney, Agent, or Firm*—Sheridan Neimark; A. Fred Starobin

[57] ABSTRACT

An umbrella without a center post supporting structure with a continuous lazy tong structure around the periphery of the canopy with the lazy tong structure connected on one side along its periphery to a supporting arm pivotally connected at its opposite end to a composite handle. The composite handle includes a substantially U shaped arm with one end pivotally connected to the supporting arm, a first slide connected to the grasping handle and at least partially slidable in the U shaped arm, a second slide pivotally connected to the first slide and slidable in the U shaped arm, a lower block firmly attached at the bottom of the U shaped arm and slidable on the first slide, an upper block slidable on the U shaped arm and connected to the lazy tong structure, and stops on the first and second slides on opposite sides of the upper block and on the side of the U shaped arm between the blocks.

9 Claims, 10 Drawing Figures

27
18
17
16
19
14
15
28
24
22
20
21
25
26
29
13
6
7

FIG. 8.
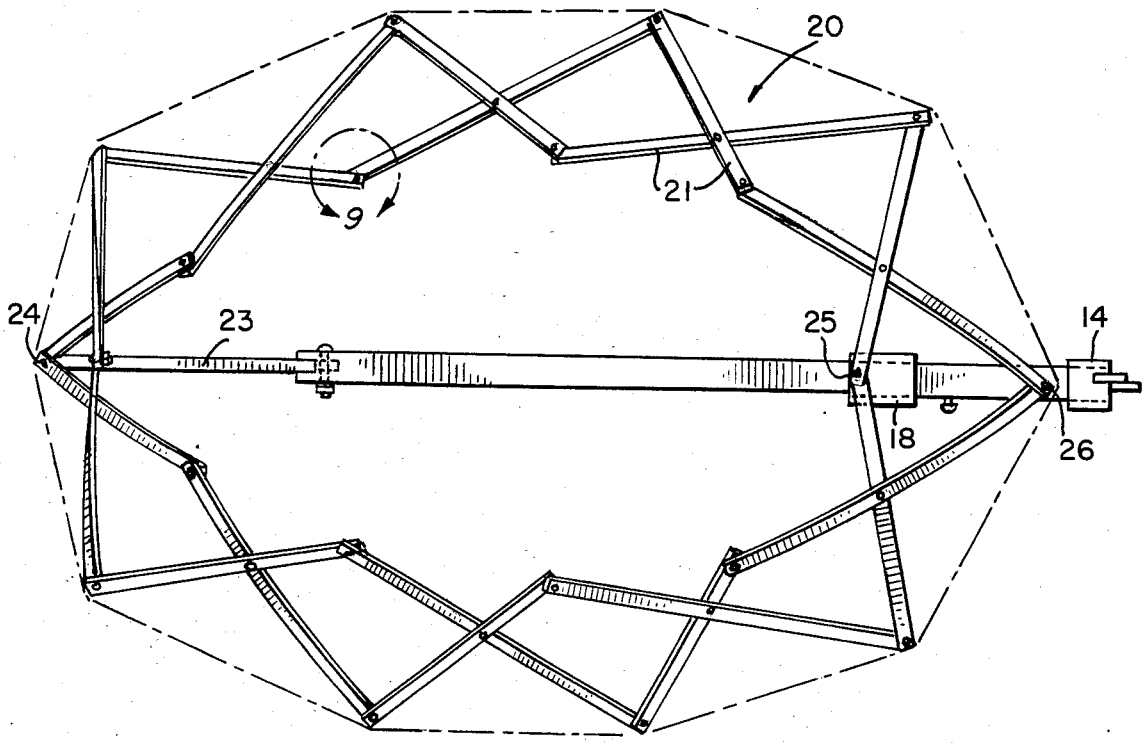
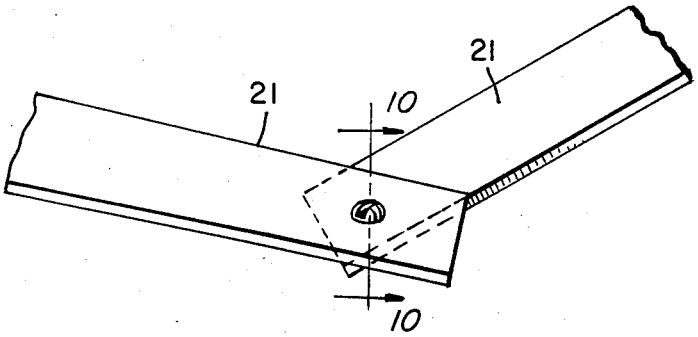
FIG. 9.
FIG. 10.
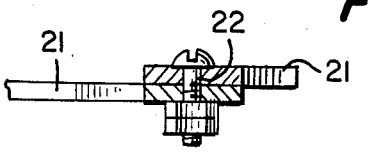

UMBRELLA WITH LAZY TONG STRUCTURE

FIELD OF THE INVENTION

The present invention relates to a new structure for an umbrella and more particularly to a foldable umbrella without a central post and utilizing a lazy tong type of structure which provides the principal support for the entire umbrella.

BACKGROUND

A lazy tong type structure in general has many uses and has been shown in the prior art for use in the support of the canopy of an umbrella. Among the prior art patents, the present applicant is one of those with such a patent showing such lazy tong structure, noting U.S. Pat. No. 4,193,415. Also see U.S. Pat. Nos. 341,192 and 1,836,322.

The problem with most prior umbrellas, however, and especially those in common usage, are manifest. They have dangerous points, they are unstable in windy environments when they are most needed, and their supporting rods or posts extend downwardly from the center making it impossible for the user to occupy the best location, i.e. the space below the center of the umbrella. Accordingly, innovative umbrella designers have tried various approaches in an attempt to overcome some of these problems.

For example, a number of prior patents propose umbrellas or the like which have supporting rods or posts which do not extend directly down from the center of the umbrella. See, for example, U.S. Pat. Nos. 1,007,812; 1,328,901; 2,605,778; 2,764,993; 2,948,289; 3,304,035; 2,871,868; 3,441,038; 3,765,434; 533,371; 96,777; 738,554; and 1,006,454. These all, however, suffer from various defects, either being so complex in construction as to be unduly expensive and mechanically unreliable, and/or being incapable of simple, effective and reliable folding and unfolding.

SUMMARY OF THE INVENTION

It is therefore an object of the invention to overcome defects in the prior art, such as indicated above; and also to provide for an improved umbrella construction.

It is another object of the present invention to produce an umbrella having a strong structure obtainable without the use of a center structure as found in the prior art.

It is a further object of the present invention to have the strength of the structure in the periphery of the canopy support.

It is still another object of the present invention to allow more room for a person or persons under the umbrella unhampered by any interfering structure at the umbrella center portion.

A still further object of the present invention is to have the end of the handle of the umbrella extending to the middle area under the canopy without support from a middle support as in the prior art.

In accordance with the present invention a hinged handle extends from and is integrally connected to a lazy tong structure extending along the periphery of the canopy support structure without any use being made of a center support structure for an umbrella.

BRIEF DESCRIPTION OF THE DRAWINGS

The foregoing and other advantages and features of the invention may best be understood by reference to the accompanying drawings, showing by way of illustration, a preferred embodiment thereof, and in which:

FIG. 8 is a plan view of the umbrella in fully open position;

FIG. 9 is a enlarged view of a connecting pivot point on the lazy tong structure in the portion encircled by line 9 in FIG. 8; and FIG. 10 is a sectioned view of the connecting pivot point along line 10—10 of FIG. 9.

DESCRIPTION OF THE PREFERRED EMBODIMENT

Figure 1:
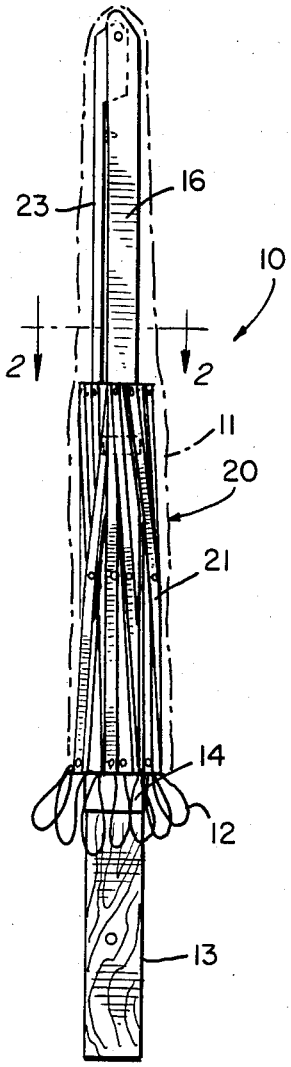
FIG. 1 shows the umbrella of the present invention in fully closed position with the fabric shown only in dashed outline in the figures so as to better illustrate the support structure.
Figure 3:
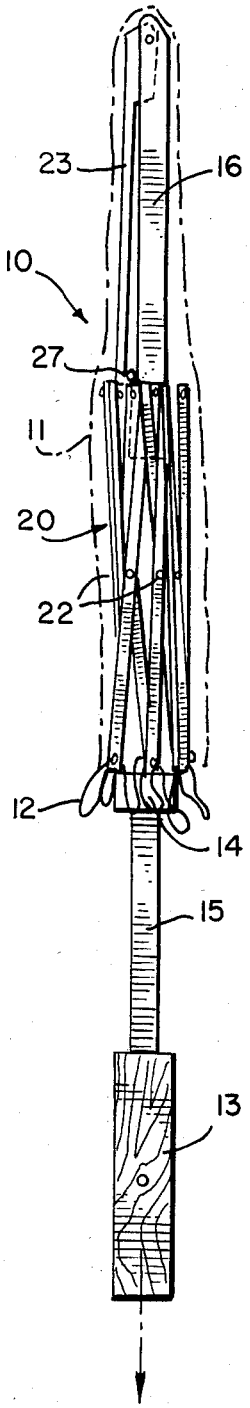
FIGS. 3, 4 and 5 illustrate steps in opening of the umbrella of the present invention.
Figure 4:
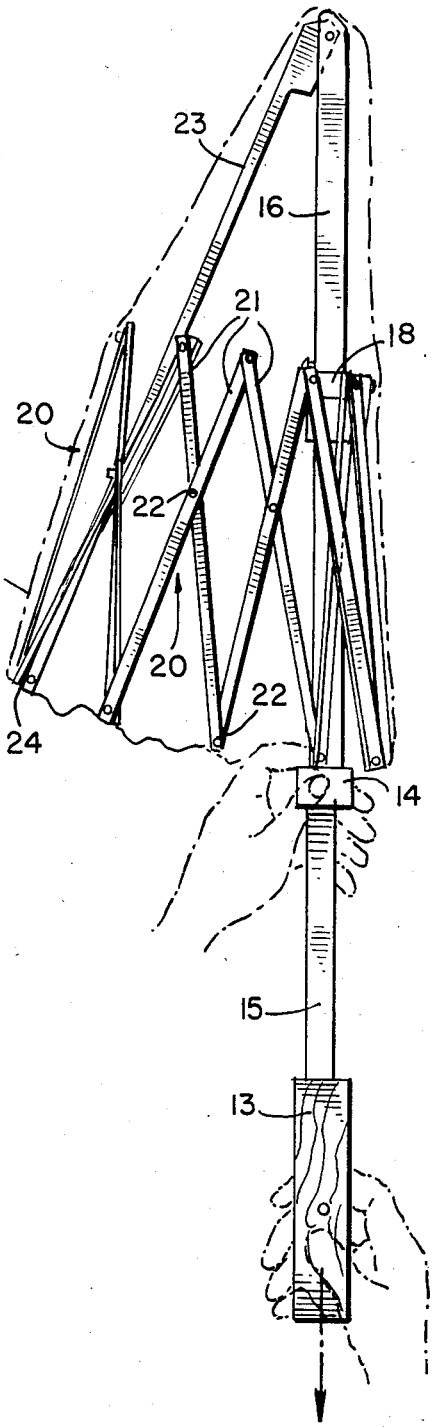
Figure 2:
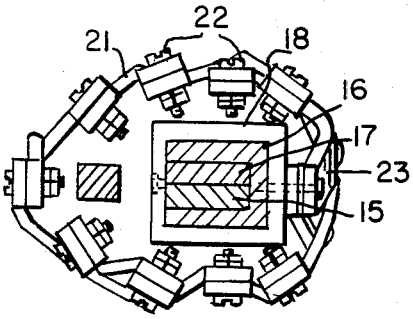
FIG. 2 is a sectional view taken along line 2—2 in FIG. 1.
Figures 5, 6, 7:
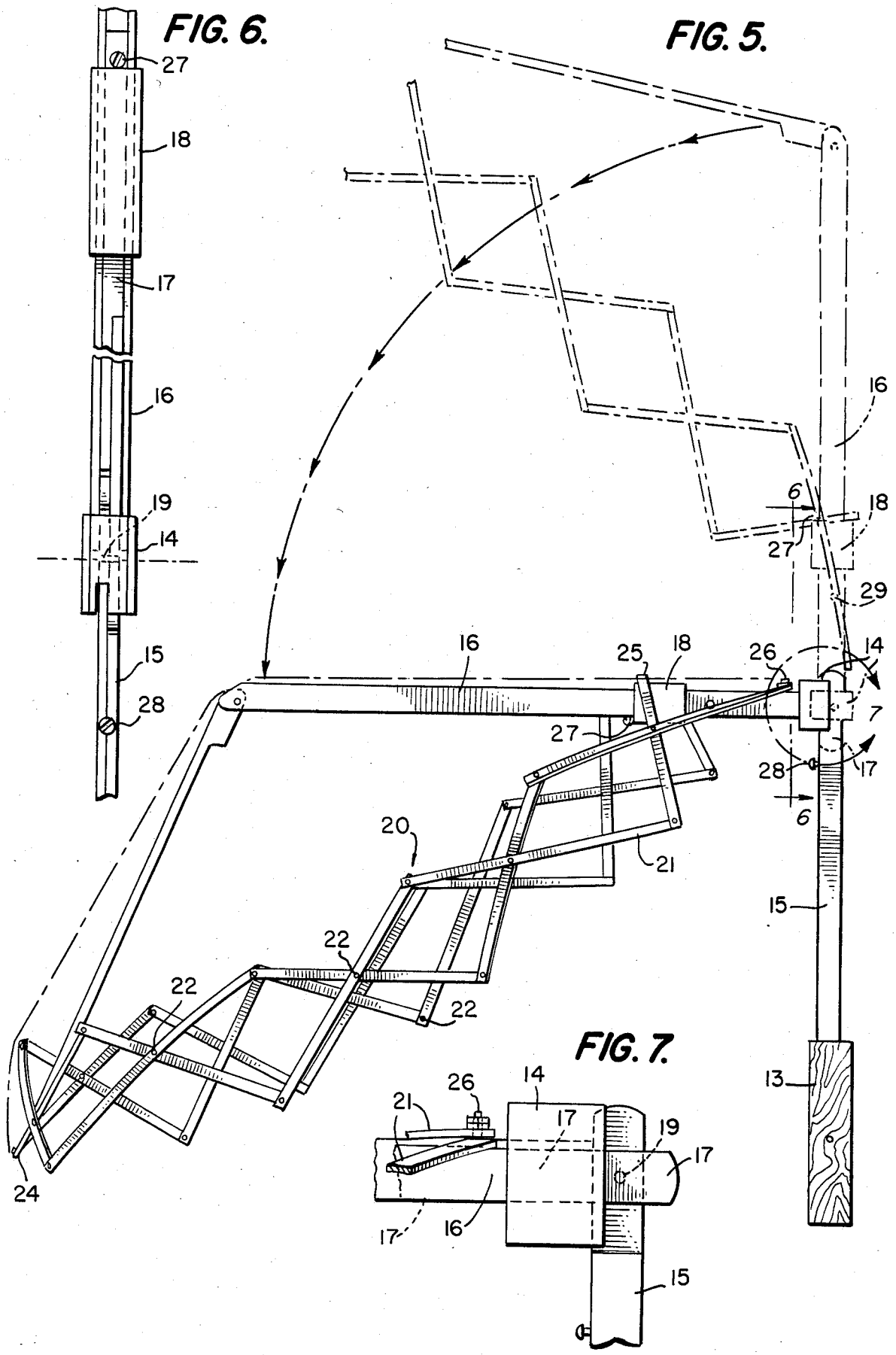
FIG. 6 is an enlarged view illustrating interconnecting parts of a portion of an arm of the handle of the umbrella viewed along line 606 in FIG. 5.
FIG. 7 is an enlarged view of the hinged part of the arm of the handle of the umbrella in the portion encircled by line 7 in FIG. 5.

Referring first to FIG. 1, there is shown the umbrella 10 in fully closed position. The fabric forming canopy 11 is shown in dashed outline with the bottom edge shown in solid line 12. The arm forming the handle portion of the umbrella 10 is composed of a handle 13 which is here shown as a rectangular block but which may be shaped in any of several forms to be accommodated as an umbrella handle. As the umbrella 10 is opened as shown in FIGS. 3, 4, and 5, with additional details of structure shown in FIGS. 2, 6 and 7, handle 13 is moved downward from lower block 14. Firmly attached or integral with the handle 13 is first slide 15 which passes through lower block 14 into hollow arm 16 as shown in more detail in FIG. 6. Hollow arm 16 is formed so as to be open along one edge to allow a stop mounted on each of slides 15 and 17 to protrude therefrom. It should be noted that first slide 15 extends through lower block 14 only in the closed or partially closed positions of umbrella 10 is depicted in FIGS. 1 through 6. First slide 15 pivotally connects with second slide 17, which slide 17 is mounted to slide in hollow arm 16, passing through upper block 18. Upper block 18 is slidingly mounted on hollow arm 16.

Lazy tong structure 20 is composed of crossed struts 21 as further shown in FIGS. 7 through 10. These struts 21 are pivotally connected in pairs at their centers and at their ends to the next crossed pair by bolt or screw connecting means 22 which are passed through holes such as are shown in FIGS. 9 and 10.

Arm 23 is pivotally connected to hollow arm 16 at its upper end and hollow arm 16 is connected firmly and integrally at its lower opposite end to lower block 14. On one side of lazy tong structure 20, as shown in FIG. 8, a pair of struts 21 pivotally connected at their ends are connected at these same ends pivotally to arm 23 at pivot point 24.

On the opposite side of lazy tong structure 20 from pivot point 24, structure 20 is pivotally connected to upper block 18 at pivot point 25 and to hollow arm 16 at pivot point 26.

The operation is facilitated by the use of stops with stop 27 near the top of second slide 17, stop 28 spaced a short distance from the pivotal connection between first slide 15 and second slide 17 on first slide 15. Both of these stops extend outward from the open edge on hollow arm 16. A third stop 29 extends from the side of hollow arm 16 between upper block 18 and lower block 14.

In opening umbrella 10 the operation as shown in the figures starts from the fully closed umbrella of FIG. 1 where the bottom of upper block 18 is resting against stop 28 and handle 13 is up against lower block 14. The opening procedure is started by pulling downward on handle 13 and separating it from lower block 14 as in FIG. 3 until upper block 18 encounters stop 27. Up to that point all movement is confined to handle 13 and attached first slide 15 and second slide 17 attached thereto.

When stop 27 is encountered by the top of upper block 18, further movement of handle 13 and lower block 14 relatively away from each other causes movement of upper block 18 relatively downward in relation to hollow arm 16 and along hollow arm 16 toward lower block 14. This moves pivot point 25 on upper block 18 toward pivot point 26 on hollow arm 16 located just above lower block 14 and by this motion lazy tong structure 20 is pushed to a spread position as shown in FIG. 4. As shown in FIG. 5, lazy tong structure continues to spread and its opposite end is supported during this operation by arm 23 pivoting at the top end of hollow arm 16.

The opening action of umbrella 10 is continued by continuing the pushing of lower block 14 away from handle 13 until lower block 14 moves up first slide 15 past its pivotal connection 19 with second slide 17 until stop 29, mounted on the side of hollow arm 16 encounters the lower side edge of upper block 18. At that point lazy tong structure 20 will be opened to its greatest extent and canopy 11 will be stretched to its greatest tightness. Also since lower block 14 will have passed over stop 28 and pivotal connection 19, first slide 15 and second slide 17 can now be pivoted in relation to each other as illustrated in the movement from the dashed position to the solid line position in FIG. 5. Upon the pivotal movement of slides 15 and 17, lower block 14 will then act as a stop to prevent the accidental closing of umbrella 10 and limit furhter pivotal movement as can be seen in FIG. 7. An indentation in lower block 14 holds the edge of first slide 15 to prevent the closing and limit the pivotal movement just discussed.

With the lazy tong structure 20 extended and the slides 15 and 17 pivoted as shown in FIGS. 5, 7 and 8, the umbrella 10 is ready for use wherein a person holding handle 13, due to the pivoted position of slides 15 and 17, is positioned under canopy 11 without any interference from any center structure and with additional room under the canopy for himself and possibly an additional person because of the elimination of center structure due to the novel structure of the umbrella. For any canopy of comparable size the space available thereunder is more than for the umbrellas found in the prior art and due to the lazy tong structure the canopy is more strongly supported than by the prior art spoke construction. Also the present structure is comparatively simple and accomplishes its purpose in a simple manner.

With this structure, should a gust of wind get under the canopy, instead of breaking the support as is the tendency with center structure umbrellas, at worst the wind should straighten slides 15 and 17 relative to each other and start a closing action of the umbrella.

To close the umbrella requires straightening of slides 15 and 17 relative to each other at pivotal connection 19 and moving handle 13 toward lower block 14. Slides 17 and 15 slide into hollow arm 16 until stop 28, which has passed by lower block 14 encounters the lower edge of upper block 18, moving upper block 18 upward relative to movement along hollow arm 16, separating pivot points 25 and 26 and thereby causing the closing of lazy tong structure 20.

Although a hollow arm 16 is discussed and illustrated it is not necessary that such arm be hollow but only that it be constructed so that the first and second slides 15 and 17 are connected to arm 16 so as to slide relative to it and allow stops to protrude from the slides to contact the upper block 18 at opposite ends of its travel.

It will be obvious to those skilled in the art that various changes may be made without departing from the scope of the invention and the invention is not to be considered limited to what is shown in the drawings and described in the specification.

What is claimed is:

1. An umbrella comprising a lazy tong structure having struts interconnected at intermediate and end points on said struts forming said lazy tong structure as a substantially peripheral support;

off-set handle means connected to said lazy tong structure and including a handle at its lower end;

a support arm pivotally connected to said handle means at the upper end of said means, and with an opposite free end of said support arm connected to and supported by said lazy tong structure and with said opposite end limited in its movement by said lazy tong structure;

and a canopy attached to said lazy tong structure and draped over the end of said handle means pivotally connected to said support arm.

2. An umbrella comprising a lazy tong structure having struts interconnected at intermediate and end points and said struts forming said lazy tong structure;

handle means connected to said lazy tong structure and including a handle at its lower end;

a support arm pivotally connected to said handle means at the upper end of said handle means and with the opposite end of said support arm connected to said lazy tong structure;

and a canopy attached to said lazy tong structure and draped over the end of said handle means pivotally connected to said support arm;

said handle means further including a first arm pivotally connected at its upper end to said support arm, a first slide connected to said handle on one end of said slide and slidable relative to said first arm for at least a portion of the other end of said first slide, and a second slide slidable relative to said first arm and pivotally connected to said first slide.

3. The umbrella of claim 2 further characterized by said handle means further including a first block connected to move integrally with said first arm and attached to said first arm at an end away from the pivotal connection of said support arm to said first arm, a second block slidably connected to said first arm from movement along said first arm.

4. The umbrella of claim 3 further characterized by said first block having a slot means on its bottom to receive a side of said first slide when said first slide is in a fully pivoted position for carrying the umbrella overhead.

5. The umbrella of claim 3 further characterized by said handle means further including a first stop protruding from said first slide at a position below said second block, and a second stop protruding from said second slide at a position above said second block.

6. The umbrella of claim 5 further characterized by said handle means further including a third stop protruding from a side of said first arm in the path of said second block moving along said first arm.

7. The umbrella of claim 5 further characterized by a first connecting point connecting said lazy tong structure to an end of said supporting arm opposite from the end of said supporting arm pivotally connected to said first arm, a second connecting point connecting said second block to said lazy tong structure at an end connecting point between the end of one first strut each from two adjacent pairs of said struts, a third connecting point connecting said first arm to said lazy tong structure at an end connecting point between the ends of one second strut each from said two adjacent pairs of said struts.

8. An umbrella comprising a lazy tong structure having struts interconnected at intermediate and end points on said struts forming said lazy tong structure;

handle means connected to said lazy tong structure and including a handle at its lower end;

a support arm pivotally connected to said handle means at the upper end of said handle means and with the opposite end of said support arm connected to said lazy tong structure;

and a canopy attached to said lazy tong structure and draped over the end of said handle means pivotally connected to said support arm;

said handle means further including a first arm substantially U shaped with the open end of the U along an edge of said first arm and with said support arm pivotally connected at one end of said first arm, a first slide connected to said handle at one end of said first slide and having the other end of said first slide insertable slidingly in said first arm, a second slide pivotably connected to said first slide and slidably mounted in said first arm, a first block firmly attached to an end of said first arm opposite from the end to which said support arm is pivotally attached, a second block slidably mounted on said first arm, said lazy tong structure being a continuous structure of connected struts forming a substantially circular structure of connecting crossed struts connected at their ends to adjacent pairs of crossed struts, said lazy tong structure connected on one side of its periphery to the end of said supporting arm, and connected on the opposite side of its periphery to said second block and to said first arm between said first and seond blocks.

9. The umbrella of claim 8 further characterized by first and second stops protruding from the open end edge of said first arm on opposite sides of said second block.

* * * * *